US009487853B2

(12) United States Patent
Jang et al.

(10) Patent No.: US 9,487,853 B2
(45) Date of Patent: Nov. 8, 2016

(54) STEEL STRIP STABILIZATION DEVICE

(75) Inventors: Tae-In Jang, Gwangyang-si (KR); Chang-Woon Jee, Gwangyang-si (KR); Yong-Hun Kweon, Gwangyang-si (KR)

(73) Assignee: POSCO, Pohang, Kyungsangbook-Do (KR)

( * ) Notice: Subject to any disclaimer, the term of this patent is extended or adjusted under 35 U.S.C. 154(b) by 0 days.

(21) Appl. No.: 14/122,883

(22) PCT Filed: Jun. 2, 2011

(86) PCT No.: PCT/KR2011/004046

§ 371 (c)(1),
(2), (4) Date: Nov. 27, 2013

(87) PCT Pub. No.: WO2012/165679

PCT Pub. Date: Dec. 6, 2012

(65) Prior Publication Data

US 2014/0144967 A1 May 29, 2014

(51) Int. Cl.

| | |
|---|---|
| ***C23C 2/40*** | (2006.01) |
| ***B65H 57/00*** | (2006.01) |
| ***C23C 2/14*** | (2006.01) |

(Continued)

(52) U.S. Cl.

CPC . *C23C 2/40* (2013.01); *B05C 3/00* (2013.01); *B65H 57/006* (2013.01); *C23C 2/003* (2013.01); *C23C 2/14* (2013.01)

(58) Field of Classification Search

None

See application file for complete search history.

(56) References Cited

U.S. PATENT DOCUMENTS

| | | | | |
|---|---|---|---|---|
| 2008/0044584 | A1* | 2/2008 | Eriksson et al. | 427/430.1 |
| 2011/0050016 | A1* | 3/2011 | Jang et al. | 310/90.5 |
| 2013/0327806 | A1* | 12/2013 | Jang et al. | 226/196.1 |

FOREIGN PATENT DOCUMENTS

| | | | | |
|---|---|---|---|---|
| CN | 101698927 | * | 4/2010 | C23C 2/24 |
| CN | 101698927 A | | 4/2010 | |
| JP | 03-168410 | | 7/1991 | |

(Continued)

OTHER PUBLICATIONS

International Search Report from the Korean Patent Office for International Application No. PCT/KR2011/004046, mailing date Feb. 17, 2012.

(Continued)

*Primary Examiner* — Dah-Wei D Yuan
*Assistant Examiner* — Jethro M Pence
(74) *Attorney, Agent, or Firm* — Finnegan Henderson Farabow Garrett & Dunner LLP

(57) ABSTRACT

Provided is a steel strip stabilizing apparatus which allows shape correction and vibration suppression in a steel strip, particularly, plated steel strip, in a non-contact manner. The steel strip stabilizing apparatus includes an apparatus support body disposed on at least one side of a traveling steel strip and a steel strip stabilizing unit comprising a magnetic field generating pole disposed on the apparatus support body to face the steel strip and a pole expansion part configured to provide steel strip attraction force to a steel strip-side end of the magnetic field generating pole so as to allow shape correction or vibration suppression in the steel strip. The present invention increases the (electro)magnetic attraction force on the plated steel strip that passes through a plating bath, and thereby effectively ensures shape (curvature) correction or vibration suppression (damping) in the plated steel strip and prevents plating variations in the steel strip, and ultimately makes it possible to improve the quality of the plating of the steel strip.

8 Claims, 13 Drawing Sheets

(51) Int. Cl.

| | |
|---|---|
| ***B05C 3/00*** | (2006.01) |
| ***C23C 2/00*** | (2006.01) |

(56) References Cited

FOREIGN PATENT DOCUMENTS

| | | |
|---|---|---|
| JP | 2000-053295 | 2/2000 |
| JP | 2001-062509 | 3/2001 |
| JP | 2002-128346 | 5/2002 |
| JP | 2002-294348 | 9/2002 |
| JP | 2002-310607 | 10/2002 |
| JP | 2002-317259 | 10/2002 |
| JP | 2007-284775 | 11/2007 |

OTHER PUBLICATIONS

Extended European Search Report dated Oct. 6, 2014 in corresponding European Application No. 11867094.2, 6 pages.

Japanese Office Action dated Feb. 3, 2015 in corresponding Japanese Application No. 2014-513411, 6 pages including English language translation.

* cited by examiner

STEEL STRIP STABILIZATION DEVICE

TECHNICAL FIELD

The present invention relates to a steel strip stabilizing apparatus which corrects a shape of a steel strip, particularly, a transferred plated steel plate or damps vibrations of the plated steel strip in a non-contact manner.

More particularly, the present invention relates to a steel strip stabilizing apparatus which increases (electro) magnetic attraction force with respect to a plated steel strip passing through a plating bath to effectively correct a shape (curvature) or suppress (damp) vibrations in the plated steel strip, thereby ultimately improving quality in plating of the steel strip.

BACKGROUND ART

In recent years, demand for (zinc) plated steel strips, which enhance corrosion resistance, etc., have desirable aesthetic qualities, and in particular, are used as steel sheets for electronic products or automobiles, has rapidly increased.

FIG. 1 illustrates a process for plating a steel strip, particularly, a zinc-plating process.

For example, as shown in FIG. 1, a zinc plating process for steel strips is performed by allowing molten zinc to be attached to surfaces of a steel strip (for example, a cold-rolled steel strip) 100 while the steel strip passes through a snout and a zinc plating bath 110 after the steel strip is unwound from a pay-off reel and is thermally treated with a welding machine and a looper.

Here, a gas wiping device (for example, an air knife) 120 provided directly above the plating bath may spray a gas (for example, an inert gas or air) onto a surface of the steel strip to properly reduce the amount of zinc plated on the steel strip, thereby controlling the plating thickness of the steel strip.

Also, the plated steel strip may continuously pass through a sink roll 112 that allows the steel strip to pass through the plating bath 110 and adjusts a tension of the steel strip, a stabilizing roll 114, which are provided in the plating bath 110, and an upper transfer roll 130.

As shown in FIG. 1, the molten zinc filled in the zinc plating bath 110 may have a temperature of about 450° C. to about 460° C. The steel strip 100 passing through the plating bath 110 may have various types, widths, and thicknesses.

However, loads applied to (a roll shaft of) the sink roll 112 may be generally different according to types of steel strips. For example, a maximum load of about 500 kgf may be applied to both ends of the sink roll 112. Thus, when dynamical properties such as vibration occur, a maximum load of about 100 kgf may be applied to both ends of the sink roll 112 in a rotation direction of the sink roll 112.

Thus, while the plated steel strip 100 passing through the sink roll 112 and the stabilizing roll 114 passes through the upper transfer roll 130, vibrations in the steel strip 100 may occur even if the vibrations are varied according to the types, widths, or thickness of steel strips. Here, the occurrence of the vibration in the steel strip may cause a plating deviation between the gas wiping device 120 and the steel strip, resulting in a plating failure.

On the other hand, when a curvature phenomenon (for example, a C-shaped curvature or S-shaped curvature phenomenon in which a central portion of the steel strip is recessed or curved in a width direction of the steel strip) in which the steel strip is non-uniform in shape occurs, a plating deviation in the width direction of the steel strip may occur, thus resulting in the plating failure.

Thus, as shown in FIG. 1, at least one steel strip stabilizing apparatus (a so-called a "steel strip damping apparatus") 140 for correcting the shape of the steel strip or suppressing vibration in the steel strip may be disposed between the gas wiping device 120 and the upper transfer roll 130.

The steel strip stabilizing apparatus 140 may damp (suppress) the vibrations in the plated steel strip or control the curvature shape in the steel strip to transfer the steel strip in a state in which the steel strip is flat, thereby preventing the plating deviation from occurring.

Although schematically shown in FIG. 1, the steel strip stabilizing apparatus 140 according to the related art may damp vibrations in the steel strip or correct the shape of the steel strip by using a mechanical touch roll that is in contact with the steel strip or spraying a gas onto the steel strip.

However, in the case of using the mechanical touch roll, since the roll contacts the surface of the transferred plated steel strip in a state in which the molten zinc is not completely attached (dried) to the surface of the steel strip by passing through the gas wiping device, a surface roll marker may be easily formed on the surface of the plated steel strip, and particularly, foreign matters may be attached to the surface of the steel strip by using the touch roll as a medium to cause quality defects in the plated steel strip.

For example, since most steel strips for vehicles are used in vehicle frames, the surface defects in the steel strip may cause significant quality defects in products. Also, the contact type roll may cause vibrations and noise due to abrasion thereof and also increase vibrations in the transferred plated steel strip due to unstable rotation thereof.

The related-art method for damping vibrations in the steel strip or correcting the shape of the steel strip by spraying the gas onto the steel strip may have limitations in which vibration suppression and shape correction in the steel strip are inefficient, and particularly, if the gas is sprayed onto the surface of the steel strip in the state where a plating solution is completely dried and thus is not attached to the surface of the steel strip, it may have an influence on the plating thickness of the steel strip.

Accordingly, a technique which enables the steel strip to be corrected in shape and damped (suppressed) in vibrations through a steel strip non-contact manner instead of the mechanical contact or gas spraying manner is required. For this, a method using electromagnetic force has been proposed as the other method in the related art.

However, in the case of the related-art method using the electromagnetic force, even in the case that the steel strip is suppressed in vibrations or corrected in shape through magnetic attraction force with respect to the steel strip in the non-contact manner, this may be merely a simple configuration in which a magnet block for generating magnetic fields (magnetic force) is disposed adjacent to the steel strip. Also, since the magnet block has a small unit area, the magnet block may cause stress concentration in the steel strip when the steel strip is damped in vibration and corrected in shape.

For example, in a case of a thin film having a thin thickness of about 0.6 t, a steel strip may be dented to cause surface defects of the steel strip.

Furthermore, as demand for plated steel strips used as steel strip for vehicles is rapidly increasing, large-scaled plating equipment and high-speed plating may be required.

However, the related-art steel strip stabilizing apparatus using the simple magnet block structure may have limitations in use.

DISCLOSURE

Technical Problem

An aspect of the present invention provides a steel strip stabilizing apparatus which improves shape correction or vibration damping (vibration suppression) in a steel strip, i.e., a plated steel strip to prevent a plating deviation from occurring in the steel strip, thereby ultimately improving quality in plating of the steel strip.

Another aspect of the present invention provides a steel strip stabilizing apparatus which measures a gap (distance) between the apparatus and a steel strip by using a non-contact type eddy current sensor to accurately maintain the distance between the apparatus and the steep strip on the basis of quick response characteristics, thereby further improving shape correction or vibration damping in the steel strip, and also, maintains a magnetic field generating pole at a contact temperature to improve a life-cycle of one apparatus.

Another aspect of the present invention provides a steel strip stabilizing apparatus in which an apparatus support body or a magnetic field generating pole is cooled to stably correct a shape of a steel strip or suppress vibrations of the steel strip through (electro) magnetic attraction force.

Technical Solution

According to an aspect of the present invention, there is provided a steel strip stabilizing apparatus including: an apparatus support body disposed on at least one side of a traveling steel strip; and a steel strip stabilizing unit including a magnetic field generating pole disposed on the apparatus support body to face the steel strip and a pole expansion part configured to provide steel strip attraction force to a steel strip-side end of the magnetic field generating pole.

The pole expansion part of the steel strip stabilizing unit may have a size greater than a thickness of at least the magnetic field generating pole by using a rounded portion disposed on a front end of the magnetic field generating pole as a medium.

At least one steel strip stabilizing unit may be disposed on the apparatus support body, and at least one apparatus support body may be arranged in a width direction of the steel strip.

The magnetic field generating pole may be provided, in plurality on the apparatus support body, and the plurality of magnetic field generating poles may be independently provided or connected to each other by using a connection part as a medium in a traveling direction of the steel strip on the apparatus support body.

The steel strip stabilizing unit may include one of a coil-type steel strip stabilizing unit of which the magnetic field generating pole is constituted by a core member formed of a magnetic material and an electromagnetic coil wound around the core member and a magnet-type steel strip stabilizing unit of which the magnetic field generating pole includes a permanent magnet or electromagnet to correct a shape of the steel strip or suppress vibrations of the steel strip.

The electromagnetic coil may be wound around at least one of the plurality of magnetic field generating poles connected to each other by using the connection part as the medium.

The pole expansion part disposed on the magnetic field generating pole may have a width greater about one-and-a half times to about five times than a diameter of the electromagnetic coil wound around, the core member of the coil-type steel strip stabilizing unit or than a thickness of the magnetic field generating pole of the magnet-type steel strip stabilizing unit.

The electromagnetic coil of the coil-type steel strip stabilizing unit may be provided on the core member in parallel.

The steel strip stabilizing apparatus may further include at least one of an eddy current sensor and a distance sensor which are configured to measure a gap between the pole expansion part and the steel strip.

The steel strip stabilizing apparatus may further include a cooling unit provided in one or all of the apparatus support body and the magnetic field generating pole disposed on the apparatus support body.

Advantageous Effects

According to the present invention, the (electro) magnetic attraction force with respect to the steel strip may increase, and the magnetic field generating pole having various shapes may be provided to control the applied current. As a result, the shape correction and/or vibration damping in the plated steel strip may be improved, and thus, plating deviations in the steel strip may be reduced to improve the plating quality of the steel strip.

Also, the (electro) magnetic force may be used to prevent the steel strip surface defects due to the existing mechanical contact manner from occurring and also prevent contact abrasion from occurring. Thus, the steel strip stabilizing apparatus may be semipermanently used.

Furthermore, the gap (distance) between the apparatus and the steel strip may be measured by using the eddy current sensor (or the distance sensor) on the basis of the accurate and quick response characteristics to control the gap between the steel strip and the apparatus. As a result, the (electro) magnetic attraction force with respect to the steel strip may be uniformly controlled or maintained to uniformly correct the shape of the steel strip or damp vibrations of the steel strip.

Also, the apparatus support body or the magnetic field generating pole may be cooled to stably correct the shape of the steel strip or suppress vibrations of the steel strip through the (electro) magnetic attraction force.

DESCRIPTION OF DRAWINGS

The above and other aspects, features and other advantages of the present invention will be more clearly understood from the following detailed description taken in conjunction with the accompanying drawings, in which.

MODE FOR INVENTION

Exemplary embodiments of the present invention will now be described in detail with reference to the accompanying drawings.

Figure 2:
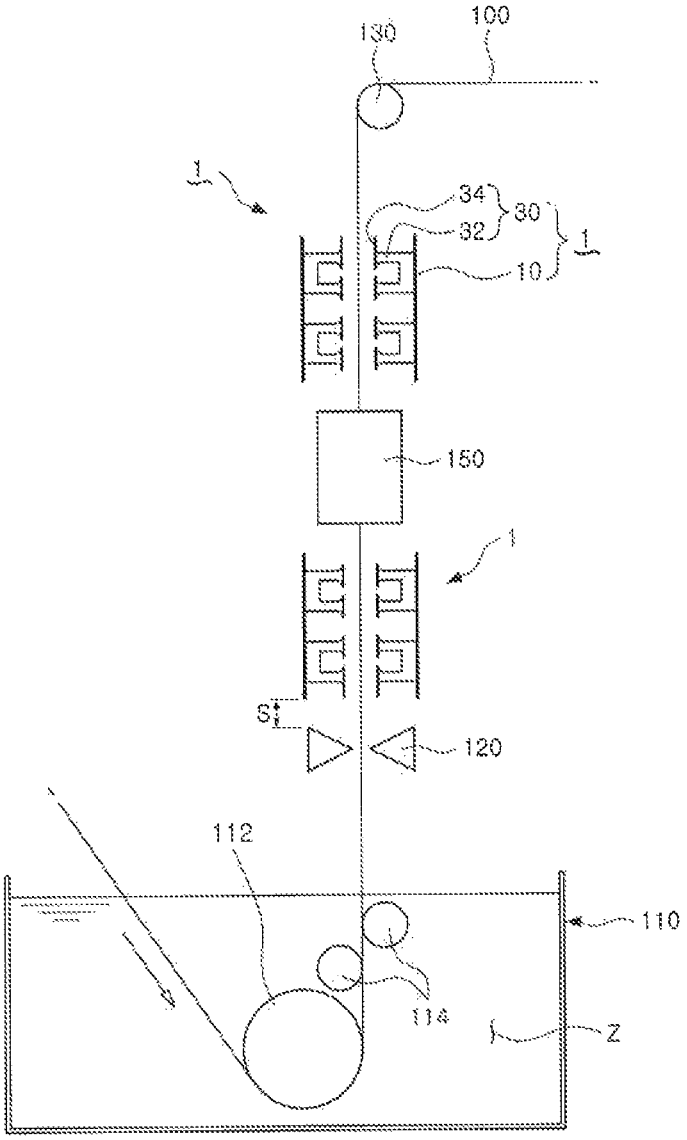
FIG. 2 is a schematic view illustrating an example of a steel strip plating process using a steel strip stabilizing apparatus according to the present invention.
Figure 3:
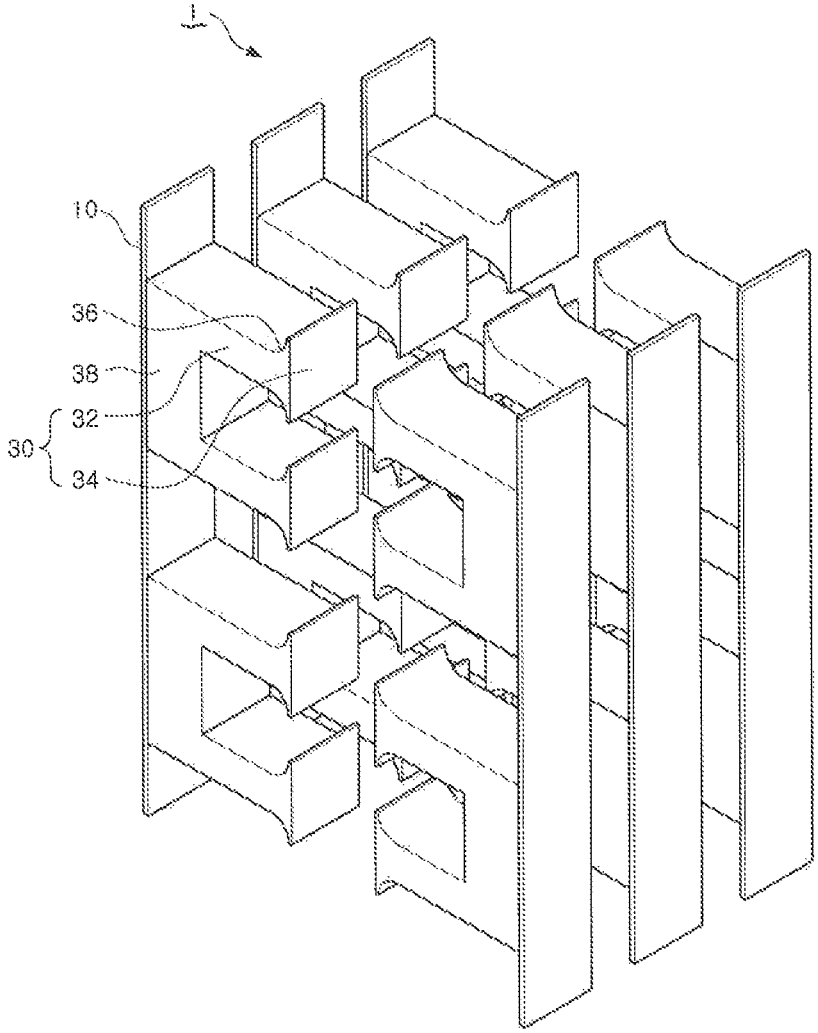
FIG. 3 is a perspective view of the steel strip stabilizing apparatus of FIG. 2 according to the present invention.

FIGS. 2 to 4 are schematic view of a steel strip stabilizing apparatus 1 according to the present invention.

Figure 1:
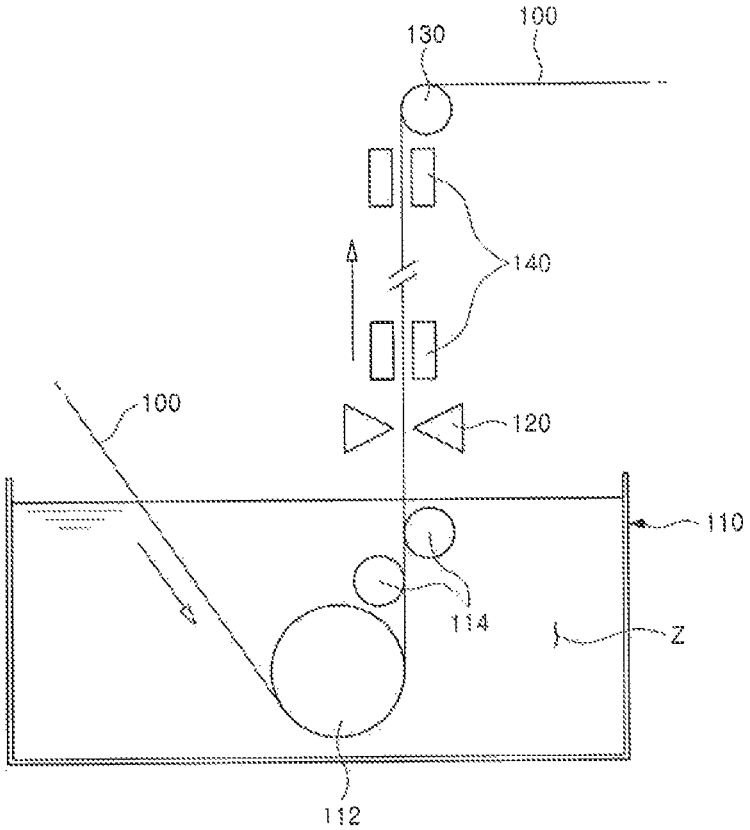
FIG. 1 is a schematic view of a steel strip plating process according to a related art.

As shown in FIG. 2, the steel strip stabilizing apparatus 1 may perform shape correction and/or vibration suppression in a plated steel strip 100 that is plated with zinc by passing through a plating bath 110 of the zinc plating equipment of FIG. 1 in the current embodiment. Thus, the plating bath 110 including a sink roll 112 and a stabilizing roll 114, a gas wiping device 120, and an upper transfer roll 130 which are installed in a plating line will be denoted by the reference numerals of FIG. 1 according to the related art.

Here, the shape correction in the steel strip may represent a process in which a shape defect, which is bent in a width direction, of the steel strip passing through the gas wiping device 120, i.e., a C-curvature or L-curvature of the steel strip 100 is corrected to provide a flat steel strip 100 passing through the gas wiping device 120, thereby preventing a plating deviation from occurring in the steel strip 100.

Also, the vibration damping, i.e., vibration suppression of the steel strip 100 may represent a process for preventing a phenomenon in which the steel strip is abnormally controlled in plated thickness due to vibrations of the transferred steel strip 100 while passing through the gas wiping device 120.

Although it is described that the steel strip stabilizing apparatus 1 of the present invention is applied to a steel strip plating line, i.e., a zinc plating line of the steel strip in this embodiment, the steel strip stabilizing apparatus 1 may be applied to a continuous production line along which the steel strip 100 is continuously transferred when manufacturing the steel strip 100.

For example, the steel strip stabilizing apparatus may also be applied to a steel strip surface treatment process in which the shape defect such as the C-curvature or L-curvature or vibrations may occur when the steel strip travels to affect the production and quality of the steel strip.

Also, the steel strip stabilizing apparatus 1 of the present invention may be symmetrically disposed on both sides of the traveling steel strip to realize uniform and stable vibration damping of the steel strip.

However, the present invention is not limited thereto. For example, the steel strip stabilizing apparatus 1 may only be provided on one side of the traveling steel strip. At this time, (electro) magnetic force may be properly controlled.

As shown in FIG. 2, at least one steel strip stabilizing apparatus 1 may be disposed spaced a predetermined distance S, for example, a distance S of about 0.5 m to about 2 m upward from the gas wiping device 120 disposed above the plating bath 110.

For example, vibrations of the steel strip 100 in the plating line may cause a plating deviation when an amount of (zinc) plating solution on a surface of the steel strip 100 is reduced to control the plated thickness of the steel strip 100 by wiping a gas in the gas wiping device 120. Thus, the steel strip stabilizing apparatus 1 may be disposed to be spaced upwardly from the gas wiping device 120 by the predetermined distance S to prevent the shape defect or vibration of the steel strip 100 from occurring when the gas wiping is performed.

Here, if beyond the above range, for example, the distance S between the steel strip stabilizing apparatus 1 and the gas wiping device 120 is less than that of about 0.5 m, since the steel strip stabilizing apparatus 1 is disposed very close to the gas wiping device 120, plating solution scattering particles generated when wiping the gas may be attached to the steel strip stabilizing apparatus 1 to affect operation stability and accuracy of the steel strip stabilizing apparatus 1.

On the other hand, if the distance S between the steel strip stabilizing apparatus 1 and the gas wiping device 120 is greater than that of about 2 m, since the steel strip stabilizing apparatus 1 is disposed further away from the gas wiping device 120, the shape correction and vibration damping of the steel strip 100 in the gas wiping region may be ineffective (insufficient).

As shown in FIG. 2, the steel strip stabilizing apparatus 1 of the present invention may be (further) disposed between a steel strip cooling device 150 for cooling the plated, steel strip 100 of which the plated thickness is adjusted by wiping the gas, i.e., a mist cooler and the upper transfer roll 130 disposed in the same line as the stabilizing roll 114 for controlling the traveling of the steel strip 100.

As shown in FIGS. 2 to 4, the steel strip stabilizing apparatus 1 of the present invention may include an apparatus support body 10 disposed on at least one side of the traveling steel strip 100, i.e., the plated, steel strip 100 traveling to pass through the plating bath 110, preferably, both sides of the traveling steel strip 100 and a steel strip stabilizing unit 30 including at least one magnetic field generating pole 32 disposed on the apparatus support body 10 to face the steel strip 100 and a pole expansion part 34 of the magnetic field generating pole that is provided on a steel plate-side end of the magnetic field generating pole 32 to increase electromagnetic or magnetic attraction force with respect to the steel strip 100.

Thus, the steel strip stabilizing apparatus 1 of the present invention may flatly correct the shape defect of the steel strip 100 such as the C-curvature or L-curvature or suppress or at least minimise vibrations of the steel strip 100 in a non-contact manner using the (electro) magnetic force, unlike the shape correction or vibration damping of the steel strip using the existing mechanical contact type roll, the gas spraying, or the simple magnet block. As a result, the occurrence of the steel strip surface detect or the inefficient shape correction or vibration damping of the steel strip due to the gas spraying in the contact manner according to the related art may be removed.

Particularly, since the pole expansion part 34 is provided, for example, in a so-called pole shoes shape having a horizontal expansion surface in the traveling direction of the steel strip 100 in the magnetic field generating pole 32 for generating the (electro)magnetic force that attracts the steel strip 100 to correct the shape of the steel strip 100 or suppress vibrations of the steel strip 100, the steel strip 100 may be vary stably corrected in shape or damped in vibrations even though the steel strip is a thin film when compared to the steel strip damping through the existing simple magnet block.

As shown in FIG. 3, the apparatus support body 10 may have a plate shape lengthily extending in the traveling direction of the steel strip 100. The apparatus support body 10 may be manufactured by using a nonmagnetic material, for example, ceramic or stainless steel (SUS) to prevent the magnetic field from leaking when the (electro) magnetic force is generated.

Although schematically shown in the drawings, the apparatus support body 10 of the present invention 10 may be fixedly connected to the whole equipment-side frame (not shown) of the plating line.

Also, the apparatus support body 10 may be properly adjusted in size according to the number of steel strip stabilizing unit 30 to be installed. As shown in FIG. 3, at least one apparatus support body 10 may be disposed in the width direction of the steel strip 100 to generate the steel strip attraction force in a region greater than at least width of the steel strip 100 through the (electro) magnetic force in the width direction of the steel strip 100.

As shown in FIG. 3, in the steel strip stabilizing apparatus 1 of the present invention, a pair of steel strip stabilizing units 30 may be disposed on upper and lower portions of the unit apparatus support body 10 lengthily extending in the traveling direction of the steel strip 100, and then, the unit apparatus support body 10 may be disposed in a plurality of rows in the width direction of the steel strip 100.

Here, the arrangement of the unit apparatus support bodies 10 may vary in consideration of the thickness and width of the steel strip 100.

As shown in FIG. 3, in the steel strip stabilizing apparatus 1 of the present invention, the pole expansion part 34 that is substantially provided in the magnetic field generating pole 32 of the steel strip stabilizing unit 30 for generating the (electro)magnetic attraction force with respect to the steel strip 100 to expand a range of a(n) (electro)magnetic effect with respect to the steel strip 100 may be disposed to be parallel to the steel strip 100 by using a rounded part 36 integrally disposed on a steel strip-side front end of the magnetic field generating pole 32 as a medium.

That is, since the magnetic field generating pole expansion part 34 of the present invention is provided as an electromagnetic emission surface disposed parallel to the traveling steel strip 100 and is expanded in area through the rounded part 36 of the front end of the magnetic field generating pole 32, the magnetic fields generated in the magnetic field generating pole 32 may be uniformly emitted from the pole expansion part 34 onto the entire area of the steel strip 100, thereby uniformly providing strong attraction force on the whole.

Here, the pole expansion part 34 of the magnetic field generating pole 32 of the present invention may be integrally formed (processed) with the magnetic field generating pole 32. Alternatively, if it is difficult to integrally process the pole expansion part 34 and the magnetic filed generating pole 32, an iron plate (a plate material) that is a (ferro) magnetic body may be attached to the magnetic field generating pole 32.

Figure 4A:
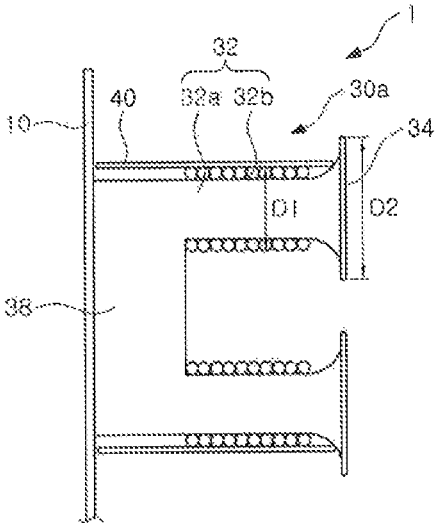
FIGS. 4A and 4B are side views illustrating various shapes of the steel strip stabilizing apparatus according to the present invention.
Figure 4B:
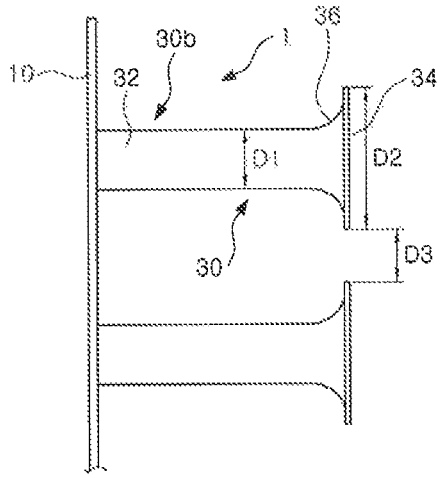

In the steel strip stabilizing apparatus 1 of the present invention, the steel strip stabilizing unit 30 for substantially realizing the shape correction and vibration damping of the steel strip 100 may be provided in various shapes as shown in FIGS. 4A and 4B.

That is, as shown in FIG. 4A, the steel strip stabilizing unit 30 of the present invention may be provided, as a coil-type steel strip stabilizing unit 30*a* including a core member 32*a* formed of a magnetic material and an electromagnetic coil 32*b* wound around the core member 32*a*.

For example, the electromagnetic coil 32*b* for generating electromagnetic force when current is applied may be wound around the core member 32*a* that is manufactured, by laminating an SM45C-based material or a silicon steel plate to constitute the magnetic field generating pole 32. Here, the magnetic field generating pole expansion part 34 may be vertically integrated with the core member 32*a*.

As shown in FIG. 4A, in the coil-type steel strip stabilizing unit 30*a*, the electromagnetic coil 32*b* wound around the core member 32*a* may be surrounded by a cover body 40, e.g., a nonmagnetic material that does not affect the electromagnetic force such as synthetic resin or stainless to prevent plating particles or foreign matters from being inserted or accumulated between the coils.

Alternatively, as shown in FIG. 4B, the steel strip stabilizing unit 30 of the present invention may be provided as a magnet-type steel strip stabilizing unit 30*b* in which the magnetic field generating pole 32 is provided as a permanent magnet or electromagnet.

Here, as shown in FIGS. 4A and 4B, the pole expansion part 34 provided in the magnetic field generating pole 32 may have a width D2 (e.g., a height in the traveling direction of the steel strip 100) greater about one-and-a half times to about five times, preferably, about two times than a diameter D1 of the electromagnetic coil 32*b* wound around the core member 32*b* in the case of the coil-type steel strip stabilizing unit 30*a* or a thickness D1 of the magnetic field generating pole 32 in the case of the magnet-type steel strip stabilizing unit 30*b*.

For example, if the width D2 of the pole expansion part 34 is less than about one-and-a half times the diameter or thickness D1 of the electromagnetic coil 32*b* or the magnetic field generating pole 32, the strength of the (electro) magnetic fields in the magnetic field generating pole expansion part 34 may increase exiguously and thus be equal to that in the vibration damping mechanism having the block shape according to the related art. As a result, steel strip attraction force per unit area, which is generated by the magnetic field generating pole expansion part 34 may excessively increase to increase stress concentration in the steel strip 100. For example, in a case in which the steel strip 100 is a thin film having a thickness of about 0.6 t, the steel strip 100 may be dented.

On the other hand, if the width D2 of the pole expansion part 34 is greater than about five times the diameter or thickness D1 of the electromagnetic coil 32*b* or the magnetic field generating pole 32, the magnetic field generating pole expansion part 34 may excessively increase in area to reduce the (electro) magnetic effect, i.e., the attraction force with respect to the steel strip 100. Thus, it may be difficult to normally correct the shape of the steel strip 100 or damp the vibration of the steel strip 100.

As shown, in FIGS. 4A and 4B, a gap D3 between the pole expansion parts 34 of the magnetic field generating poles 32 of the upper and lower unit steel strip stabilizing units may be about 20 mm to about 40 mm. For example, if the gap D3 is less than about 20 mm, the pole expansion parts 34 may be disposed very close to each other. Thus, electromagnetic forces emitted from the magnetic field generating pole expansion parts 34 may interfere with each other to reduce the steel strip attraction force. On the other hand, if the gap D3 is greater than about 40 mm, unnecessary space may be occupied to increase the whole size of the steel strip stabilizing apparatus 1.

Figure 5:
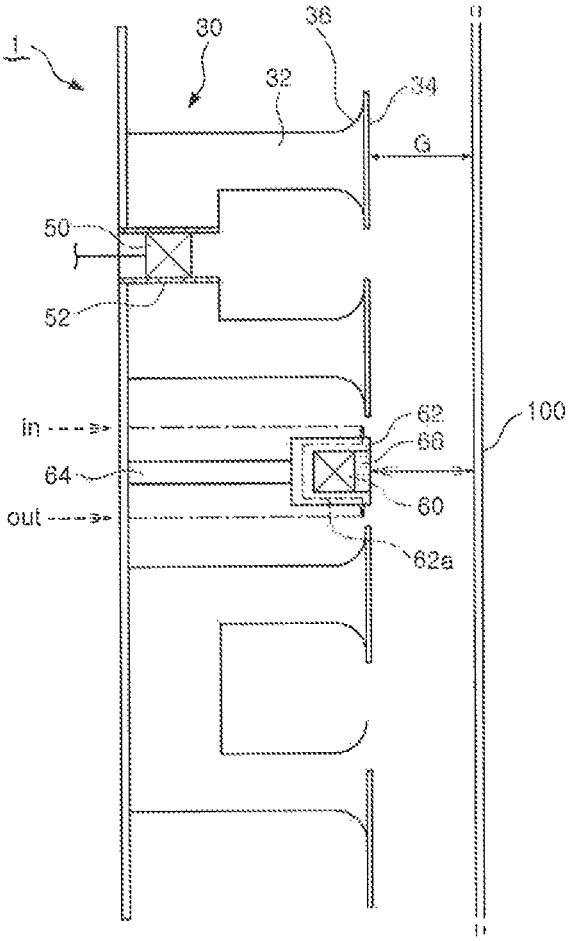
FIG. 5 is a side view of the steel strip stabilizing apparatus of FIG. 3 according to the present invention.

As shown in FIG. 5, the steel strip stabilizing apparatus 1 of the present, invention may include sensors for measuring a gap G between the steel strip stabilizing unit 30, i.e., the magnetic field generating pole expansion part 34 and the traveling steel strip 100, i.e., the plated steel strip 100.

For example, as shown in FIG. 5, a known eddy current sensor 50 provided in a sensor mounting hole 52 within an opening defined in the apparatus support body 10 and a connection part 38 of the upper and lower magnetic field generating pole 32 to measure the gap G by using the strength of the magnetic fields may be used as the sensors.

Alternatively, a distance sensor 60, e.g., a laser distance sensor connected to the apparatus support body 10 between the unit steel strip stabilizing units 30 may be provided together with the eddy current sensor 50 or independently provided to measure the gap G between the magnetic field generating pole expansion part 34 and the steel strip 100.

However, since the distance sensor 60 may easily cause a measurement failure (error) in an actual plating environment, the eddy current sensor 50 for detecting a wavelength of the magnetic fields to detect eddy current between the sensor and the steel strip 100, thereby measuring the gap G may be used instead of the distance sensor 60. Of cause, it is not impossible to use the distance sensor 60.

The eddy current sensor 50 may detect a change in impedance of the electromagnetic coil 32*b* according to a change in magnetic field that interacts with a change in distance between the sensor 50 and the steel strip 100 (actually, the gap G between the apparatus pole expansion part 34 and the steel strip 100) to measure the gap G. A probe type sensor instead of an encircling type sensor through which an object to be measured passes may be used as the eddy current sensor 50 used in the present invention.

Here, in the case of using the distance sensor 60, a cooling type distance sensor that is connected to the apparatus support body 10 and allows coolant or air to flow therein may be used as the distance sensor 60 because the plating process of the present invention is performed at a high temperature. For example, as shown in FIG. 5, the distance sensor 60 may be disposed within a housing 62 of a connecting rod 64 connected to the apparatus support body 10, and a window 66 may be disposed on a front side of the distance sensor 60. Particularly, the distance sensor 60 may have a passage 62*a* through which the coolant or air is introduced and discharged.

Also, the gap G between a front surface of the expansion part 34 of the magnetic field generating pole 32 and the steel strip 100 may be defined within a measure critical range in which the eddy current sensor 50 or the distance sensor 60 is capable of measuring the gap G.

For example, the gap G that is capable of being measured by using the eddy current sensor 50 may be in a range of about 0.1 mm to about 44 mm. Here, the gap G may not get out of the above range.

Also, to realize optimum vibration damping of the steel strip 100, the gap G may be properly adjusted according to the previously known size, thickness, and traveling speed of the steel strip 100.

FIGS. 6 to 8 are schematic views illustrating various shapes of the steel strip stabilizing apparatus 1, particularly, the steel strip stabilizing unit 30 according to the present invention.

Figure 6A:
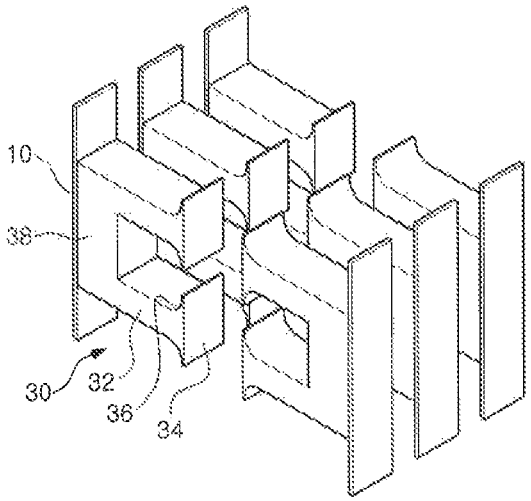
FIGS. 6A and 6B are perspective and side views illustrating a magnetic field generating pole of the steel strip stabilizing apparatus according to an embodiment of the present invention.
Figure 6B:
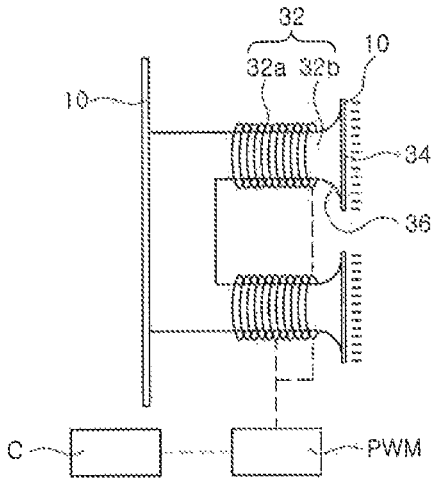
Figure 7A:
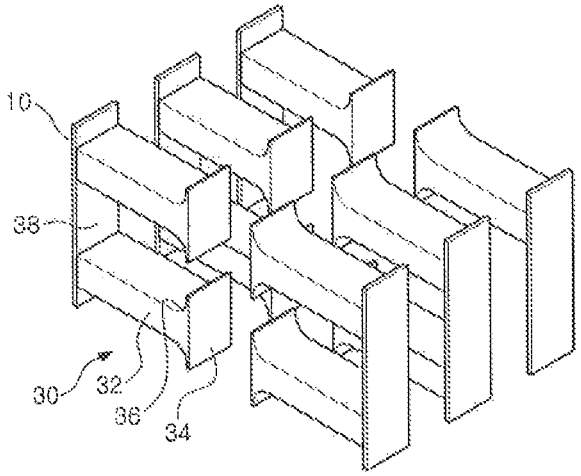
FIGS. 7A and 7B are perspective and side views illustrating a magnetic field generating pole of a steel strip stabilizing apparatus according to another embodiment of the present invention.
Figure 7B:
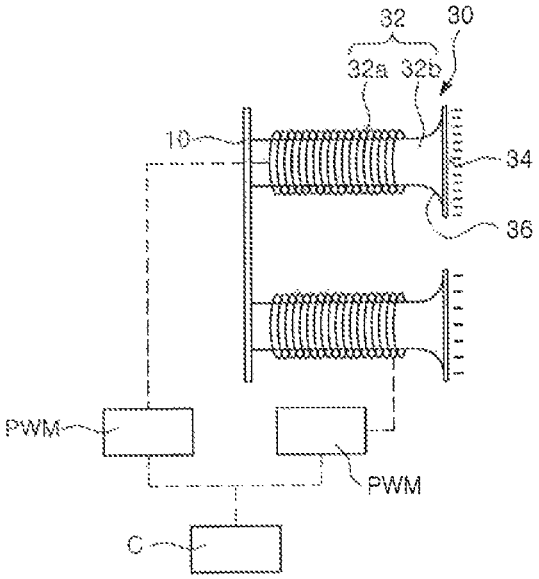
Figure 8A:
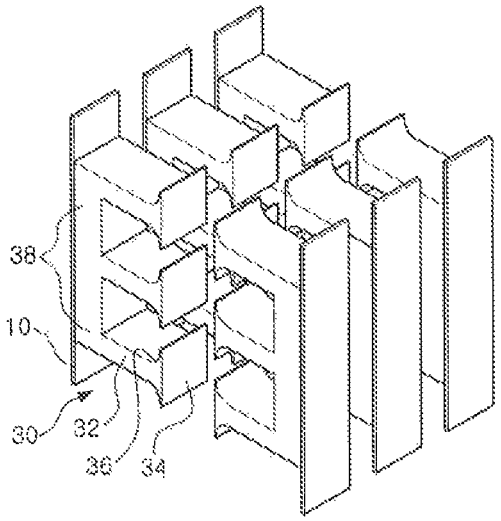
FIGS. 8A and 8B are perspective and side views illustrating a magnetic field generating pole of a steel strip stabilizing apparatus according to further another embodiment of the present invention.
Figure 8B:
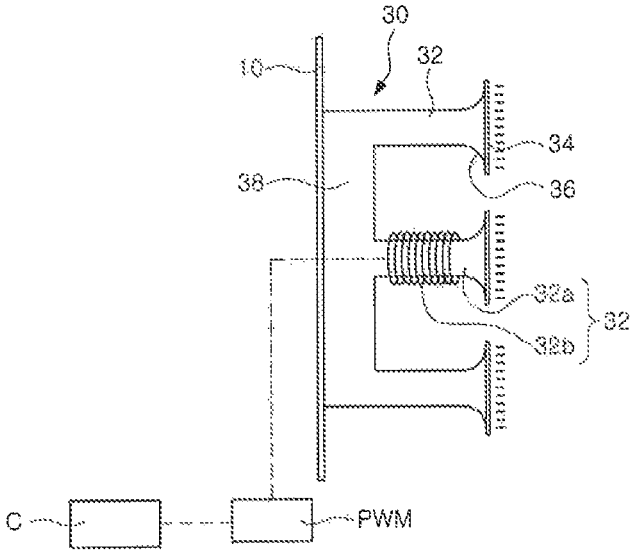

FIGS. 6A, 7A, and 8A illustrate the magnet-type steel strip stabilizing unit 30*b* in which the magnetic field generating pole 32 is provided as the permanent magnet or electromagnet as shown in FIG. 4B. FIGS. 6B, 7B, and 8B illustrate the coil-type steel strip stabilizing unit 30*a* of FIG. 4A including the magnetic field generating pole 32 in which the electromagnetic coil 32*b* is wound around the core member 32*a*.

That is, as shown in FIGS. 6A and 6B, the steel strip stabilizing unit 30 of the present invention may have a "ㄷ" shape in which the upper and lower magnetic field generating poles 32 are connected to each other by using the connection part 38 as a medium.

In this case, even though the electromagnetic coil 32*b* is wound, around each of the magnetic field generating poles 32, the electromagnetic forces emitted from the magnetic field generating poles 32 may be the same by the connection part 38. Thus, current applied to each of the wound coils may be adjusted by one pulse width modulation (PWM) driver and a control unit C connected to the PWM driver. That is, even if current applied to the wound coils is different, the electromagnetic forces (magnetic fields) emitted from the magnetic field generating poles 32 may be the same.

However, as shown in FIGS. 7A and 7B, in the case in which each of the upper and lower magnetic field generating poles 32 is independently installed on the apparatus support body 10 that is one nonmagnetic material to provide a unit magnetic field generating pole having a "T" shape, when current applied to the electromagnetic coil 32*b* wound around the core member 32*a* by the PWM driver controlled by the control unit C is differently controlled, the magnetic forces emitted from the upper and lower magnetic field generating poles 32 may be different.

As shown in FIGS. 8A and 8B, three magnetic field generating poles 32 may be connected to the one apparatus support body 10 by using a dual connection part 38 as a medium, for example, the whole magnetic field generating pole 32 may have an "E" shape when viewed from a front side. In this case, as shown in FIG. 6, since the same electromagnetic force is emitted from the whole magnetic field generating pole 32, even though the electromagnetic coil 32*b* is wound around only the intermediate core member 32*a*, the electromagnetic forces (magnetic fields) generated by the three magnetic field generating poles 32 may be the same.

Thus, the steel strip stabilizing units 30 of FIGS. 6 to 8 having various shapes may be selectively used according to the shape correction or vibration damping of the steel strip 100. For example, the plurality of magnetic fields generating poles of FIG. 8 may be used for the condition in which the vibration of the steel strip 100 is relatively large according to the thickness or width of the steel strip 100 or plating line. When it is necessary to generate magnetic forces different from each other in the magnetic field generating poles 32, the shape of FIG. 7 may be selected. Also, the shape of FIG. 6 may be provided as a fundamental shape.

However, in any shape, as shown in FIGS. 6 to 8, the plurality of magnetic field generating poles 32 may be independently installed on the apparatus support body 10 in the traveling direction of the steel strip 100 or installed by using the connection part 38 as a medium. Here, the plurality of magnetic field generating poles 32 may be arranged in parallel with the steel strip 100 at the same distance to provide uniform electromagnetic force.

Also, in the case of the plurality of magnetic field generating poles 32 connected to each other by using the connection part 36 as a medium, one electromagnetic coil 32*b* may be wound to simplify a structure of the steel strip stabilizing apparatus 1 as shown in FIG. 8.

Figure 9A:
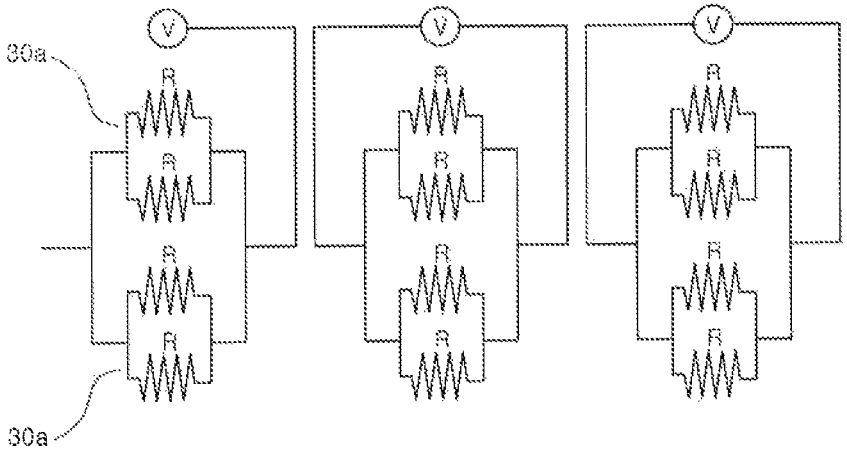
FIGS. 9A and 9E are a circuit diagram and a schematic view illustrating a coil configuration in the magnetic field generating pole of the steel strip stabilizing apparatus according to the present invention.
Figure 9B:
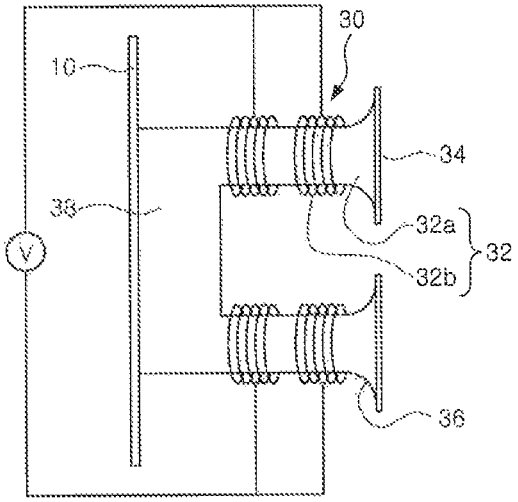

As shown in FIGS. 9A and 9B, a plurality of electromagnetic coils 32*b* of the coil-type steel strip stabilizing unit 30*a* may be provided on the core member 32*a* in parallel as shown in FIG. 4A when the core members 32*a* of the magnetic field generating pole 32 are connected to each other by using the connection part 38 as a medium.

That is, as shown in FIGS. 9A and 9B, when the electromagnetic coils are provide on the core member in parallel, applied current may be the same. Thus, the electromagnetic forces generated in the magnetic field generating poles 32 may be uniformly provided on the whole to maintain uniform vibration damping performance.

Also, as shown in FIG. 2, the steel strip stabilizing apparatus 1 of the present invention may generate the (electro) magnetic force on both sides of the traveling plated steel strip 100 to attract the plated steel strip 100, thereby correcting the shape defect of the steel strip 100 or suppressing vibrations of the steel strip 100. That is, in the case in which the vibration damping is performed, the electromagnetic force may be controlled in real time.

Figure 10A:
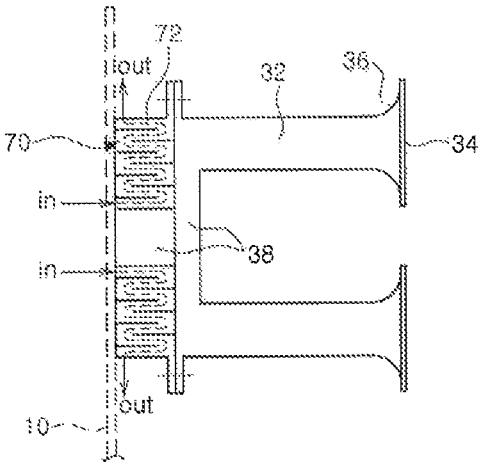
FIGS. 10A to 10C are schematic views of a cooling unit provided in the magnetic field generating pole or an apparatus support body in the steel strip stabilizing apparatus according to the present invention.
Figure 10B:
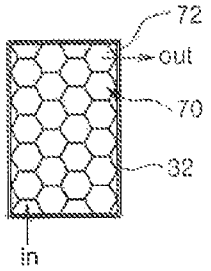
Figure 10C:
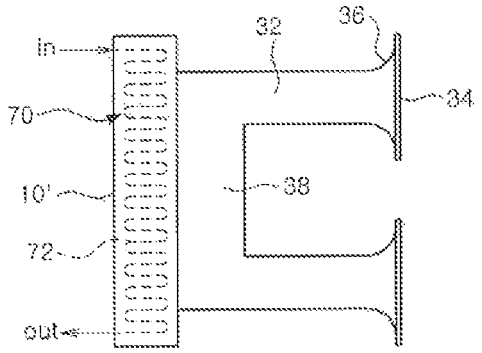

Referring to FIG. 10, the steel strip stabilizing apparatus 1 of the present invention may further include a cooling unit 70, i.e., a cooling medium flow type cooling unit 70 provided in the magnetic field generating pole 32 including the permanent magnet, the electromagnet, or the core member that is mounted on an apparatus support body 10' of FIG. 10C or an apparatus support body 10 of FIGS. 10A and 10B.

For example, in the case of the zinc plated steel strip 100 passing through the zinc plating bath 110 in FIG. 2, the zinc-molten solution may have a temperature of about 450° C. to about 460° C. Thus, since the steel strip stabilizing apparatus 1 disposed above the gas wiping device may be exposed to the high temperature, the magnetic field generating pole 32 may be maintained at least 150° C. to smoothly generate the (electro)magnetic force without having an influence on the temperature.

That is, the apparatus support body or the magnetic field generating pole may be cooled by allowing a nitrogen gas or coolant to flow therein so that it prevent the at least magnetic field generating pole from being reduced in efficiency and from reaching a curie temperature at which the (electro) magnetic force is weaken.

As shown in FIGS. 10A and 10B, the cooling unit 70 of the present invention may have a hive-shaped cooling medium passage 72 through which the coolant or nitrogen gas flows into a rear end of the magnetic field generating pole 32 (that is, the permanent magnet, the electromagnet, or the core member). Also, cooling medium supply and discharge tubes (not shown) are connected to one end and the other end of the cooling unit 70, respectively.

Thus, the cooling medium may cool the magnetic field generating pole 32 so that the magnetic field generation pole 32 is maintained at the above-described temperature to allow the magnetic field generating pole 32 to generate the optimum electromagnetic force.

Here, a portion of the magnetic field generating pole 32 on which the cooling unit 70 is installed may have a flange structure to connect a portion of a main body of the magnetic field generating pole 32 to a portion of a rear end of the magnetic field generating pole 32 so that the steel strip stabilizing apparatus 1 is easily manufactured and assembled.

That is, a rear portion of the magnetic field generating pole 32 on which the cooling unit 70 is provided may be provided as a separate assembly member.

For example, in a case in which a plate member formed of a magnetic material is laminated to manufacture the core member, a portion on which the cooling unit is disposed may be integrally assembled in a flange shape.

Also, the magnetic field generating pole of the steel strip stabilizing apparatus according to the present invention may expand a thickness of the apparatus support body 10' that is a separate member without providing the cooling unit 70 to the core member of the permanent magnet, the electromagnet, or the magnet (magnetic material). In addition, the cooling medium passage 72 (although schematically shown in FIG. 10C, it may have the shape as shown in FIGS. 10A and 10B) may be formed in the apparatus support body 10' so that the nitrogen gas or coolant flows to cool the apparatus support body 10'. Then, the nitrogen gas or coolant may absorb heat of the magnetic field generating pole to cool the magnetic field generating pore.

That is, in the case of installing the cooling unit on the magnetic field generating pole, although it is difficult to install the cooling unit, the cooling efficiency may be improved. On the other hand, in the case of installing the cooling unit in the apparatus support body 10' as shown in FIG. 10C, although it is easy to install the cooling unit, the cooling efficiency may be reduced. Thus, as necessary, the installation position of the cooling unit may be properly selected. Also, all of the cooling units of the magnetic field generating pole and the apparatus support body as shown in FIGS. 10A to 10C may be installed.

Figure 11:
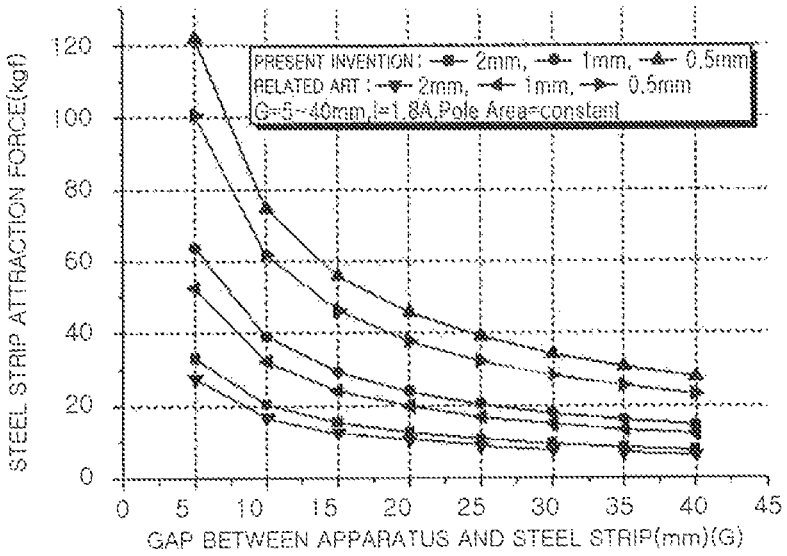
FIGS. 11 and 12 are graphs illustrating a performance curve of the steel strip stabilizing apparatus according to the present invention.
Figure 12:
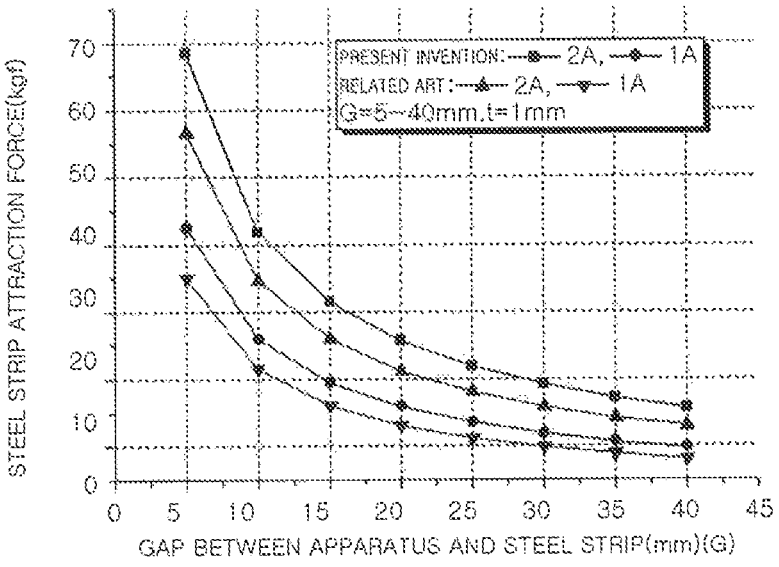

FIGS. 11 and 12 illustrate a performance curve of the steel strip stabilizing apparatus according to the present invention. In FIGS. 11 and 12, an X-axis represents a gap (see reference symbol G of FIG. 5) between the pole expansion part 34 and the steel strip, and a Y-axis represents steel strip attraction force that is determined by the (electro)magnetic force.

Thus, when the gap is about 5 mm to about 40 mm, the applied current is about 1.8 A, and the steel strip has thicknesses of about 2 mm, 1 mm, and 0.5 mm as shown in FIG. 11, it is seen that the steel strip attraction force according to the present invention increases in the entire region of the gap when compared to that according to the related art.

Also, when the gap is about 5 mm to about 40 mm, the steel strip has a thickness of about 1 mm, and the applied current is about 2 A and 1 A as shown in FIG. 12, it is seen that the steel strip attraction force according to the present invention further increases in the entire region of the gap when compared to that according to the related art.

Figure 13:
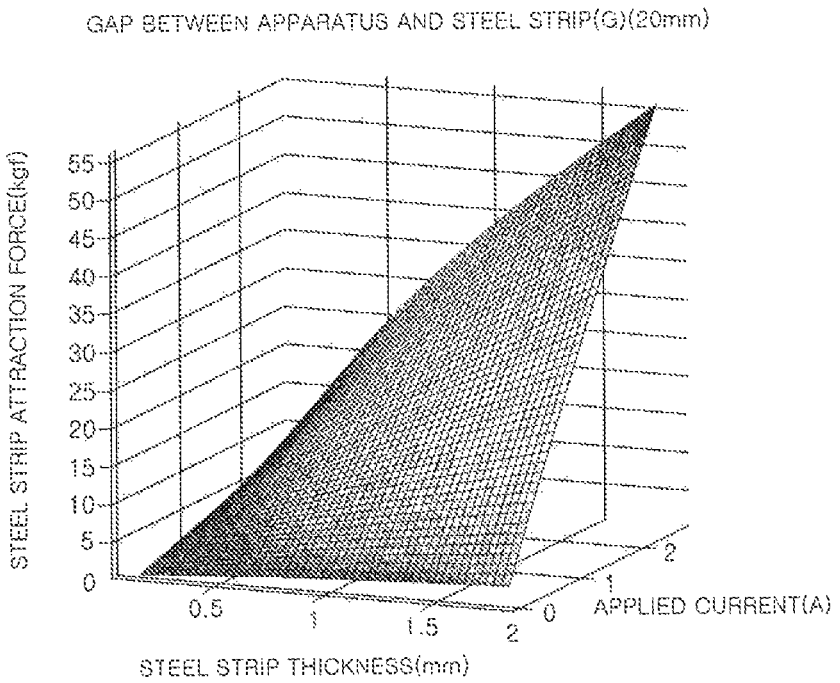
FIG. 13 is a graph illustrating a sensitive curve of a thickness and applied current of the steel strip stabilizing apparatus according to the present invention.

FIG. 13 illustrates a sensitive curve when the applied current is about 0.1 A to about 1.8 A, the gap (see reference symbol G of FIG. 5) between the above-described apparatus and the steel strip is about 20 mm, and the steel strip has a thickness of about 0 mm to about 2 mm and applied current of about 0 A to about 2 A in the steel strip stabilizing apparatus of the present invention.

For example, when the steel strip has a thickness of about 1.5 mm, and the applied current is about 1 A in FIG. 13, it is seen that the steel strip attraction force is about 45 kgf. Also, it is seen that maximum steel strip attraction force is about 55 kgf when the applied current is about 2 A.

In the above-described steel strip stabilizing apparatus 1, the (electro)magnetic force by which the steel strip attraction force is determined may be controlled by the number of installed magnetic field generating poles, the shape (width) of the pole expansion part, the number of electromagnetic coil wound around the core member, the applied (bias) current applied to the electromagnetic coil, and a control frequency when the current is applied.

That is, the dynamic properties of the (electro) magnetic force may be adjusted in consideration of the thickness or width of the steel strip or the traveling speed of the steel strip to realize the optimum vibration damping in the steel strip.

INDUSTRIAL APPLICABILITY

According to the present invention, the steel strip stabilizing apparatus may correct the shape failure of the plated steel strip and/or suppress vibrations of the steel strip by using the (electro) magnetic fields in the non-contact manner. Particularly, the (electro) magnetic attraction force with respect to the steel strip may further increase to more improve the shape correction and vibration damping properties that may have an influence on the plating deviation. Therefore, the plating deviation in the steel strip may be prevented to ultimately improve the quality of the plating on the steel strip.

While the present invention has been shown and described in connection with the exemplary embodiments, it will be apparent to those skilled in the art that modifications and variations can be made without departing from the spirit and scope of the invention as defined by the appended claims.

The invention claimed is:

1. A steel strip stabilizing apparatus comprising:

an apparatus support body disposed on at least one side of a traveling steel strip; and a steel strip stabilizing unit comprising a magnetic field generating pole disposed on the apparatus support body to face the steel strip and a pole expansion part configured to provide steel strip attraction force to a steel strip-side end of the magnetic field generating pole;

wherein the steel strip stabilizing unit comprises a steel strip stabilizing unit of which the magnetic field generating pole is constituted by a core member formed of a magnetic material and an electromagnetic coil wound around the core member to correct a shape of the steel strip or suppress vibrations of the steel strip;

wherein the pole expansion part disposed on the magnetic field generating pole has a width equal to a distance of one-and-a half to five times that of a diameter of the electromagnetic coil wound around the core member of the steel strip stabilizing unit.

2. The steel strip stabilizing apparatus of claim 1, wherein the pole expansion part of the steel strip stabilizing unit has a size greater than a thickness of at least the magnetic field generating pole by using a rounded portion disposed on a front end of the magnetic field generating pole as a medium.

3. The steel strip stabilizing apparatus of claim 1, wherein at least one steel strip stabilizing unit is disposed on the apparatus support body, and at least one apparatus support body is arranged in a width direction of the steel strip.

4. The steel strip stabilizing apparatus of claim 1, wherein the magnetic field generating pole is provided in plurality on the apparatus support body, and the plurality of magnetic field generating poles are independently provided or connected to each other by using a connection part as a medium in a traveling direction of the steel strip on the apparatus support body.

5. The steel strip stabilizing apparatus of claim 4, wherein the electromagnetic coil is wound around at least one of the plurality of magnetic field generating poles connected to each other by using the connection part as the medium.

6. The steel strip stabilizing apparatus of claim 1, wherein the electromagnetic coil of the steel strip stabilizing unit is provided on the core member in parallel.

7. The steel strip stabilizing apparatus of claim 1, further comprising at least one of an eddy current sensor and a distance sensor which are configured to measure a gap between the pole expansion part and the steel strip.

8. The steel strip stabilizing apparatus of claim 1, further comprising a cooling unit provided in one or all of the apparatus support body and the magnetic field generating pole disposed on the apparatus support body.

* * * * *